US005920996A

United States Patent [19]

Hurckman et al.

[11] Patent Number: 5,920,996

[45] Date of Patent: Jul. 13, 1999

[54] TWO-POINT SIGHT FOR ARCHERY BOW

[75] Inventors: John F. Hurckman, Green Bay; David L. Porter, Whitefish Bay, both of Wis.

[73] Assignee: Hurckman Mechanical Industries, Inc., Green Bay, Wis.

[21] Appl. No.: 08/888,639

[22] Filed: Jul. 7, 1997

[51] Int. Cl.[6] ..... F41G 1/467

[52] U.S. Cl. ..... 33/265; 124/187

[58] Field of Search ..... 33/265; 124/187

[56] References Cited

U.S. PATENT DOCUMENTS

| | | | |
|---|---|---|---|
| 2,925,656 | 2/1960 | Genovese | 33/265 |
| 3,521,362 | 7/1970 | Duplechin | 33/265 |
| 3,787,984 | 1/1974 | Bear et al. | 33/265 |
| 4,580,349 | 4/1986 | Webb et al. | 33/265 |
| 5,001,837 | 3/1991 | Bray | 33/265 |
| 5,092,052 | 3/1992 | Godsey | 33/265 |
| 5,092,053 | 3/1992 | Roberts | 33/265 |
| 5,359,780 | 11/1994 | Dellaire | 33/265 |

*Primary Examiner*—Bernard Roskoski

*Attorney, Agent, or Firm*—Basil E. Demeur; Alan B. Samlan; Robert L. Knechtel

[57] ABSTRACT

The above objects and advantages are provided for in improved archery bow sight assembly which provides a floating two-pin sight system for sighting a target. According to the invention, a sight assembly body having a forward portion and rear portion is attached directly to the bow. Pivotally attached to the front portion is a floating sight pin. Pivotally attached to the rear portion is a floating peep sight. Movement of the sight pin and peep sight is caused by a sight adjustment lever. Gear teeth on the sight adjustment lever are meshingly engaged with gear teeth on the peep sight arm. The gear teeth of the adjustment lever are indirectly engaged with the sight pin arm via idler gears. This arrangement allows the peep sight and sight pin to move in the same direction as the sight adjustment lever is manipulated. In use, the user views a target through the peep sight and, while maintaining visual contact with the target through the peep sight, intersects the peep sight with the sight pin by manipulation of the sight adjustment lever. Distance indicia located on the back outer wall of the rear portion identify the distance to the target when indicia are aligned with a peep sight.

28 Claims, 4 Drawing Sheets

TWO-POINT SIGHT FOR ARCHERY BOW

I. TECHNICAL FIELD

The present invention relates to an improved sight assembly for an archery bow. More particularly, the invention relates to a floating two-point sight assembly wherein a rear peep sight and a front sight pin simultaneously move in alignment with one another by means of a sight adjustment lever until the desired yardage is sighted, as indicated by a yardage indicator located on the rear of the sight, and maintained by viewing the floating sight pin through the floating peep sight.

II. BACKGROUND OF THE INVENTION

Accurate shot taking is the goal of all archers, whether they are in a hunting or a target shooting environment. Over the years, several bow sights have been developed to aid the archer in accurate shot placement. The prior art consists of a variety of methods by which an archer attempts to compensate for the increase in arrow trajectory with increasing target distance. Generally, this has been accomplished by mounting sight pins on the bow such that the end of the pin is in the same vertical plane as the arrow and the bow string. By adjusting these sight pins vertically, relative to the bow, an angle is formed in the vertical plane between the arrow and the sight line from the archer's eye through the end of the sight pin to the target. The great variation between types and strengths of bows and the differing aerodynamic properties of arrows has lead to sight pins being set in position by experimental means: the archer uses a target at a known distance and calibrates the bow sight by aligning the sight pin with the target and shooting. By this method the sight pin is fixed relative to the bow for the specific target range. A number of sight pins can be fixed by similar means to give the archer a number of target distance options. Most bow sights require the archer to remember which sight pin represents a particular target distance.

In addition to the sight pin, all archers try to establish an "anchor point" when the bow string is fully drawn. A constant anchor point creates a repeatable sighting geometry. A constant full draw anchor point ensures that the sight pin position the archer has established remains accurate. For example, a bow which is drawn to varying degrees will produce varying arrow speeds and, consequently, varying target ranges.

The anchor point is established by use of devices which attach to the bow string. The 'kisser' button is a small button shaped device fixed to the bow string such that the string passes through the center of the button and perpendicular to it. The kisser button is unaffected by any twisting of the bow string. The kisser button is positioned such that it contacts the archer's face, usually the lip or chin, in the same place for every draw of the bow.

An alternative to the 'kisser' button is a string peep. A string peep is a device by which an aperture can be set into the bowstring such that it aligns with the archer's eye at full draw. The string peep is used as a rear sight which is aligned with the front sight pin to accurately aim the bow. The string mounted peep sight is seen in a variety of shapes and designs. However, the general configuration is that of a disk having a peep hole in the center attached to the bow string at a point on the bow string that it lines up with the archer's eye at full draw.

The string peep has several disadvantages both in general use and more particularly in low light conditions. It can and does twist when the bow is drawn. It can create bad shooting form by encouraging the archer to draw the peep closer to the eye without giving any indication of this circumstance to the archer. The range of apertures and the closeness of the peep to the eye often allow more than one distance sight pin to be seen within the peep. This negates the peep's usefulness for sighting purposes because the archer must select a single pin for the required range. The disconnect between the string peep and the body of the bow allows the bow to be twisted about vertical (wrist torque) and horizontal axes without any indication to the archer. All sights which incorporate single point bow mounted sight pins are susceptible to this problem. For example, a string mounted peep sight is generally unpredictable in that it is usually never in the proper viewing position when at full draw. Due to its method of attachment, the bow string mounted peep sight often turns in different directions when the user pulls the bow to a full draw. Further, string mounted peep sights are prone to clogging with debris and can, therefore, hamper the user's ability to use the sight when necessary. Perhaps the greatest drawback to string mounted peep sights is that they are difficult to view through during low light conditions. This is particularly troublesome inasmuch as periods of low light, such as dawn and dusk, are ideal for hunting.

Attempts to overcome these difficulties are seen in the prior art in the form of bow mounted sights. For example, U.S. Pat. No. 5,559,780 discloses a bow mounted sight assembly having a range finder. The sight pin is mounted on a sight arm which, in turn, is designed to rotate about a pivot in direct proportion to the movement of a vertical member which is connected to the range finder. The user sights the target by manipulating the vertical member while sighting the sight pin onto the target. The range finder at the top of the device will then indicate a range to target. This device, however, represents a sight which provides only a single sight pin, and, therefore, requires that the user sight the pin directly to the target while manipulating the vertical arm until a supposed accurate sight is made. Hence, a one-position sight is provided, but the one-position consists of the one forward sight pin which is moveable by the user, and sights directly to the target. It has been found that such sight assemblies are less than accurate and capable of error.

A further example is disclosed in U.S. Pat. No. 5,001,837 which is directed to a bow mounted sight assembly having a range finder and peep sight all mounted to a forwardly extending sight assembly. The peep assembly is moveable by means of an arm carrying a lower finger control at the bottom. The device is constructed as a parallelogram such that the movement of the peep sight will move the range finder, which is located on the top portion of the unit, until a range is determined to target. As disclosed, the entire sight assembly moves forward of the bow since it is mounted on a bracket, which is, in turn, mounted to the bow. This is intended to provide adjustment capabilities. It should be noted, however, that the entire sight assembly includes numerous moving parts, and still provides only a single peep through which the user views the target in order to sight the range. It should be further noted that once the user sights the target, a locking bolt with a handle is then utilized to lock the parallelogram subassembly into a fixed orientation in order to "lock on the target". It has been found that manipulating such a sight assembly is difficult for the user, and requires several hand manipulations in order to sight the target. Further, it is difficult to lock the unit into position once the user is at full draw. In summary, the sight assembly as described provides a sight assembly which has a moveable forward peep sight as the sole sight means for sighting a target.

Yet another example is found in U.S. Pat. No. 5,092,052 which discloses a bow mounted sight having a moveable peep sight for sighting the target. This device includes a bow handle mounted bracket having a forwardly moveable peep sight. Use of this device requires the user to move a rear lever throughout a curvilinear track, which then translates motion to the forward moveable peep sight along a vertical track such that the rotary movement of the rear lever translates to vertical movement of the peep sight. Once again, this sight provides a single peep sight for sighting a target and requires the user to use a single sight window or peep sight for sighting the target. Further, the moveable portion of the sight is located on the forward end of the sight assembly, and is therefore further removed from the eye of the user.

Innovations in bow sight technology have focused on sights with a single floating sight pin which is adjustable for various target distances, as seen in U.S. Pat. No. 5,092,052. The advantage of these sights is that they eliminate confusion as to which sight pin is correct for the target distance. A single pin is moved vertically on the front of the sight while the rear of the sight acts as a range indicator. The range indicator is calibrated experimentally. These sights, however, are used in conjunction with a string peep sight or kisser button and do not solve the problem of twisting the body of the bow.

A further improvement is described and claimed in a related application for an improved bow sight filed in the names of Vanderheyden and Sweeney under Ser. No. 08/600496 and owned by Assignee Hurckman Mechanical Industries, Inc. That application describes a two-point bow mounted sight assembly. The sight assembly has a main sight body having a forward portion and a rear portion. The forward portion of the sight body contains several vertical slots into which stationery sight pins are inserted in predetermined locations specific to certain sight distances. The rear portion of the sight body contains a peep sight moveable along a curvilinear track. Movement of the peep sight is caused by an interlocking sight adjustment lever. Located on the rear wall of the curvilinear track is a distance indicator. In use, an archer locates a target through the peep sight and intersects the peep sight with the sight pin closest in accuracy to the distance indicated on the distance indicator. Thus, a more accurate two-point sighting is effectuated than when using a one-point sight. While being a vast improvement over the prior art, the drawback to this device is that it is accurate only in those circumstances in which the target is the exact distance away from the user of pre-selected sight pin.

The addition of a second sighting point mounted on the main body of the bow totally eliminates the potential for twisting. Any movement is indicated clearly by the misalignment of the two sighting points.

The present bow sight is a further improvement over the aforementioned bow sight as will be understood in connection with the following description.

III. OBJECTS AND ADVANTAGES

The present archery bow sight provides a floating two-pin sight assembly wherein the rear sight is a moveable peep sight and the front sight is a moveable sight pin. The peep sight and sight pin move in the same direction by a sight adjustment lever which meshingly engages directly with the rear peep sight arm and via idler gears with the front sight pin arm. In this manner, a floating two-pin sight assembly is provided which more accurately locates the range or distance to a target than any of the sight assemblies discussed above.

The principle object of the present invention is, therefore, to provide a floating two-pin sight assembly wherein the rear sight is a moveable peep sight and the forward sight is a moveable sight pin, both the rear peep sight and forward sight pin being moveable in tandem with each other through manipulation of a sight adjustment lever.

It is a further object of the present invention to provide a floating two-pin sight assembly for archery bows which is accurate within a complete range of distances, the distances being accurately indicated by a distance marker found on the sight assembly.

It is a further object of the present invention to provide a floating two-pin sight assembly wherein the rear peep sight and forward sight pin move in the same direction in response to the movement of a sight adjustment lever which is provided with a finger ring.

IV. SUMMARY OF THE INVENTION

The above objects and advantages are provided for in improved archery bow sight assembly which provides a floating two-pin sight system for sighting a target. According to the invention, a sight assembly body having a forward portion and rear portion is attached directly to the bow. Pivotally attached to the front portion is a floating sight pin. Pivotally attached to the rear portion is a floating peep sight. Movement of the sight pin and peep sight is caused by a sight adjustment lever. Gear teeth on the sight adjustment lever are meshingly engaged with gear teeth on the peep sight arm. The gear teeth of the adjustment lever are indirectly engaged with the sight pin arm via idler gears. This arrangement allows the peep sight and sight pin to move in the same direction as the sight adjustment lever is manipulated.

In use, the user views a target through the peep sight and, while maintaining visual contact with the target through the peep sight, intersects the peep sight with the sight pin by manipulation of the sight adjustment lever. Distance indicia located on the back outer wall of the rear portion identify the distance to the target when indicia are aligned with a peep sight.

Further objects and advantages of the present improved sight assembly for archery bows will be understood by those skilled in the arts by reference to the following detailed description of the preferred embodiment and the accompanying drawings.

V. BRIEF DESCRIPTION OF THE DRAWINGS

VI. DETAIL DESCRIPTION OF THE PREFERRED EMBODIMENT

Figure 1:
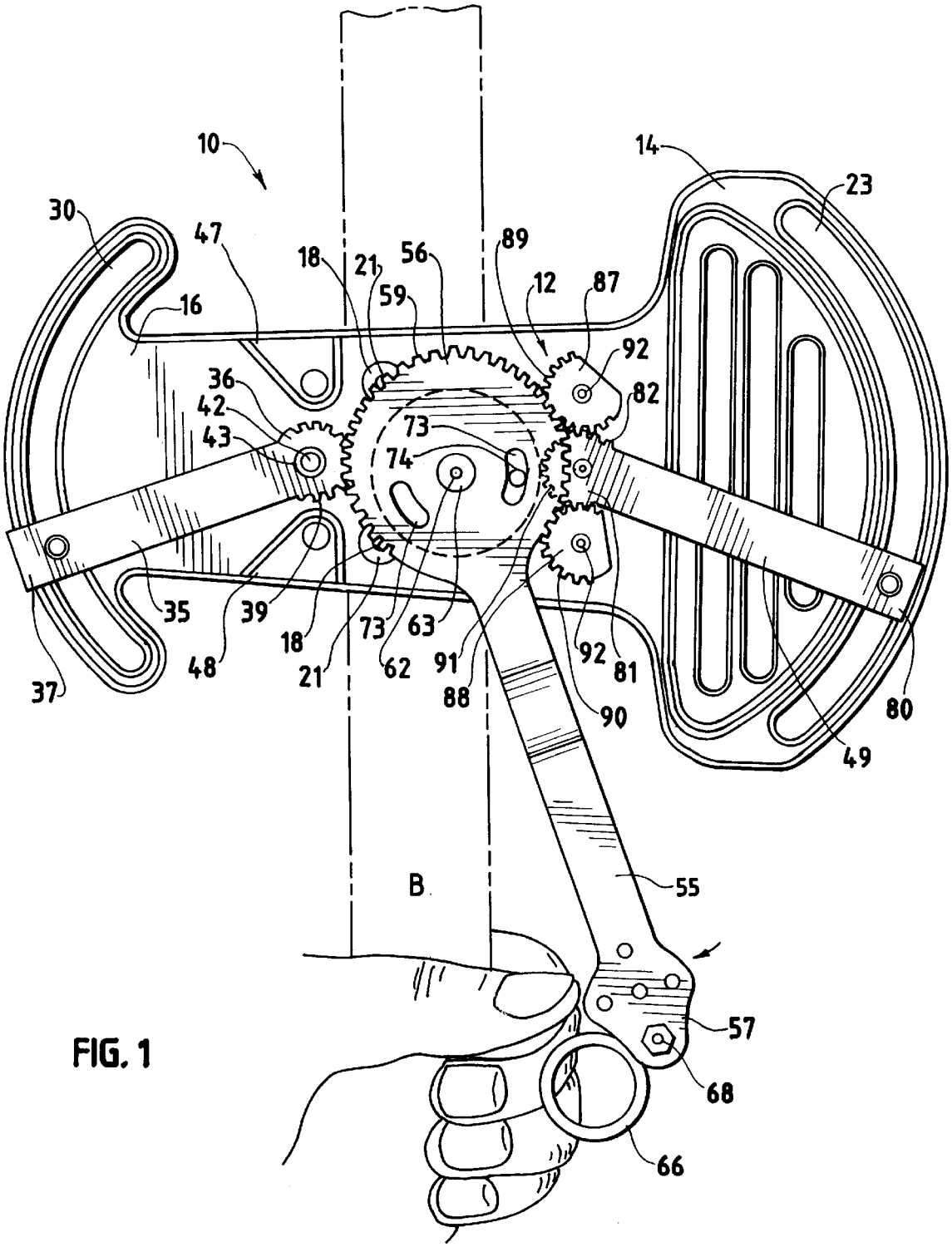
FIG. 1 is a side elevational view illustrating the inventive device mounted on to a typical archery bow.
Figure 2:
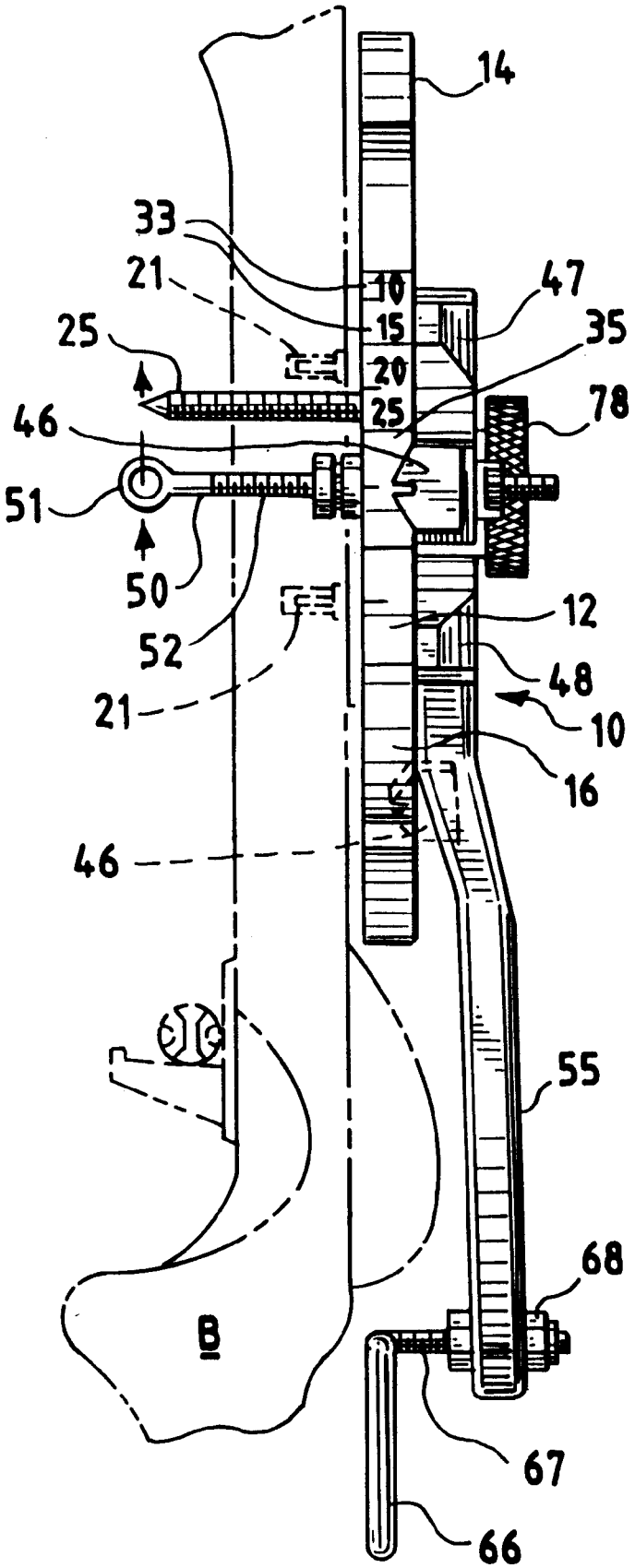
FIG. 2 is a rear elevational view showing the two-pin sight method of the present invention and the adjustability of the floating rear peep sight relative to the floating forward sight pin.

FIG. 1 depicts improved sight assembly 10. Sight assembly 10 includes a main sight body 12 having a forward body portion 14 and a rear body portion 16. Located substantially intermediate the forward body portion 14 and rear body portion 16 are a plurality of attachment apertures 18 for attaching sight assembly 10 to a typical bow B. Each attachment aperture 18 is surrounded by a chamfer 19 which allows the bolt heads of the attaching bolts 21 to be recessed relative to main body portion 12 so as not to interfere with the rotational movement of the sight adjustment lever 55 as will be more fully described hereinafter.

Forward body portion 14 is formed as a curvilinear slotted pin guide 23. The rear body portion 16 is likewise formed as a curvilinear slotted peep sight guide 30. The curvilinear slotted peep sight guide 30 is provided with a rear outer surface 32 which accommodates a distance scale 33 to be imprinted thereon.

Sight assembly 10 is further provided with a rear sight arm 35 having a front end 36 and a rear end 37. Front end 36 of rear sight arm 35 contains a plurality of gear teeth 39 which operate to pivotally move sight arm 35 in a manner to be more fully described hereinafter. Rear sight arm 35 is pivotally secured to main sight body 12 through a mounting aperture 41 and held in position by bolt 42 via washers 43 and lock nut 44. The rear 37 of rear sight arm 35 is provided with a distance pointer 46 which permits the operator to read off of distance scale 33. The path of travel of rear sight arm 35 is limited relative to main sight body 12 by means of an upper stop boss 47 and lower stop boss 48, each of which is fixedly secured to main sight body 12 by appropriate bolts (not shown). It should be clear that upper stop boss 47 and lower stop boss 48 may also be secured by means of molding the same integrally with sight body 12, or forming or machining the same as a part of sight body 12. This particular arrangement is clearly illustrated in FIG. 1 of the drawings.

As more particularly shown in figures two and three of the drawings, rear sight arm 35 is also adapted to carry a peep sight 50 which is formed by circular peep ring 51 and a threaded body 52. Once again, the peep sight 50 is mounted to rear sight arm 35 by means of a plurality of lock nuts 53 and washers 54 in the manner illustrated. Once mounted to rear sight arm 35, peep sight 50 travels within the confines of curvilinear slotted sight guide 30 thereby allowing the operator to sight a target.

Sight assembly 10 is further provided with a front sight arm 49 having a forward end 80 and a back end 81. Back end 81 contains a plurality of gear teeth 82 which operated to pivotally move front sight arm in a manner to be more fully described hereinafter. Front sight arm is pivotally secured to main sight body 12 through a mounting aperture 83, and held in place by means of bolt 84 via washers 85 and lock nut 86. Front sight arm 49 is adapted to carry a sight pin 95. Sight pin 95 is formed by a pointed free end 96 on a threaded body 97. Sight pin 95 is mounted to front sight arm 49 by means of a plurality of lock nuts 98 and washers 99. Once mounted to front sight arm 49, sight pin 95 travels within the confines of curvilinear slotted pin guide 23.

Adjacent to and above gear teeth of front sight arm is found first idler gear 87. Adjacent to and below gear teeth of front sight arm is found second idler gear 88. Both first idler gear and second idler gear have a plurality of gear teeth extending approximately ⅔ of the idler gear circumference. The gear teeth 89 of first idler gear and gear teeth 90 of second idler gear meshingly engage with the gear teeth 91 of the front sight arm. The first idler gear and second idler gear are pivotally mounted to main sight body 12 by means of bolts 92 and washers 93 and lock nuts 94.

The pivotal movement of front sight arm 49 is restricted by the first idler gear 87 and second idler gear 88. Upon rotation of the idler gears 87, 88 by sight adjustment lever 55 (described below), front sight arm 49 also pivots. When idler gears 87,88 reach the end expanse 100 of their respective gear teeth 89,90, further pivoting the front sight arm 49 is not permitted. This arrangement prevents sight pin 95 from being bent at the ends of curvilinear slot 23.

Alternatively, a single idler gear having gear teeth around its entire circumference can be used; however, stop bosses such as those used in conjunction with rear sight arm 35 must be used. If not, sight pin 95 may become bent. Also, if a single idler gear having gear teeth extending around only a portion of its circumference is used, the meshing engagement with either front sight arm 49 or adjustment lever 55 will be lost, resulting in incomplete or nonsimultaneous movement of front sight arm 49.

Sight assembly 10 is further provided with a sight adjustment lever 55 having a top end 56 and a bottom end 57. As particularly shown in FIGS. 1 and 3 of the drawings, sight adjustment lever 55 is provided with a plurality of gear teeth 59 formed along the top end 56. Gear teeth 59 are meshingly engaged with gear teeth 39 of rear sight arm 35 and gear teeth 89 of first idler gear and second gear 90. Sight adjustment lever 55 is shown to be pivotally secured to main sight body 12 through a mounting aperture 61 by means of bolt 62 and washer 63, and held in position by lock nut 64. A bottom end 57 of sight adjustment lever 55 is also provided with a finger ring 66 secured thereto by the cooperation of the threaded shaft 67 and the lock nut 68.

The top end 56 of sight adjustment lever 55 is shown further to be provided with travel restricter slot 73 as shown in FIG. 1, which operate to limit the path of travel of the entire sight adjustment lever 55. Further, the travel restricter slot 73 also functions as a tension adjustment slot in which is carried threaded mounting bolt 74 which, in turn, passes through mounting aperture 76 and includes a tension adjustment knob 78. The user may then adjust the tension and therefore the ease of movement of sight adjustment lever 55 by adjusting the tension between sight adjustment lever 55 and main sight body 12 by adjusting tension knob 78.

The underneath side 101 of sight adjustment lever 55 is cut away around its circumference such that gear teeth 56 only extend approximately one-half the thickness of the top 56 of adjustment lever 55. The thickness of front sight arm 49 is slightly less than the thickness of the cutaway portion 101 of sight adjustment lever 55. This configuration permits gear teeth 91 of front sight arm 49 to travel beneath the gear teeth 59 of sight adjustment lever 55 while maintaining meshing engagement with the gear teeth 89,90 of idle gears 87, 88. Thus, the proper gear ratios (discussed below) are maintained.

Sight adjustment lever 55, rear sight arm 35, first idler gear 89 and second idler gear 90, and front sight arm 49 are pivotally mounted to main sight body 12 in the manner previously indicated. Once sight assembly 10 is mounted to bow B, whichever hand the user uses for grasping the bow is the hand which the user will use to insert a finger through finger ring 66 and control the movement of sight adjustment lever 55. Due to the meshing gear arrangement between top end 56 of sight adjustment lever 55 and gear teeth 39 of rear sight arm 35, gear teeth 89 of the first idler gear 87 and the gear teeth 90 of the second idler gear 88, a concomitant unidirectional pivotal movement of rear sight arm 35 and front sight arm 49 is achieved as the archer adjusts sight adjustment lever 55.

Figure 3:
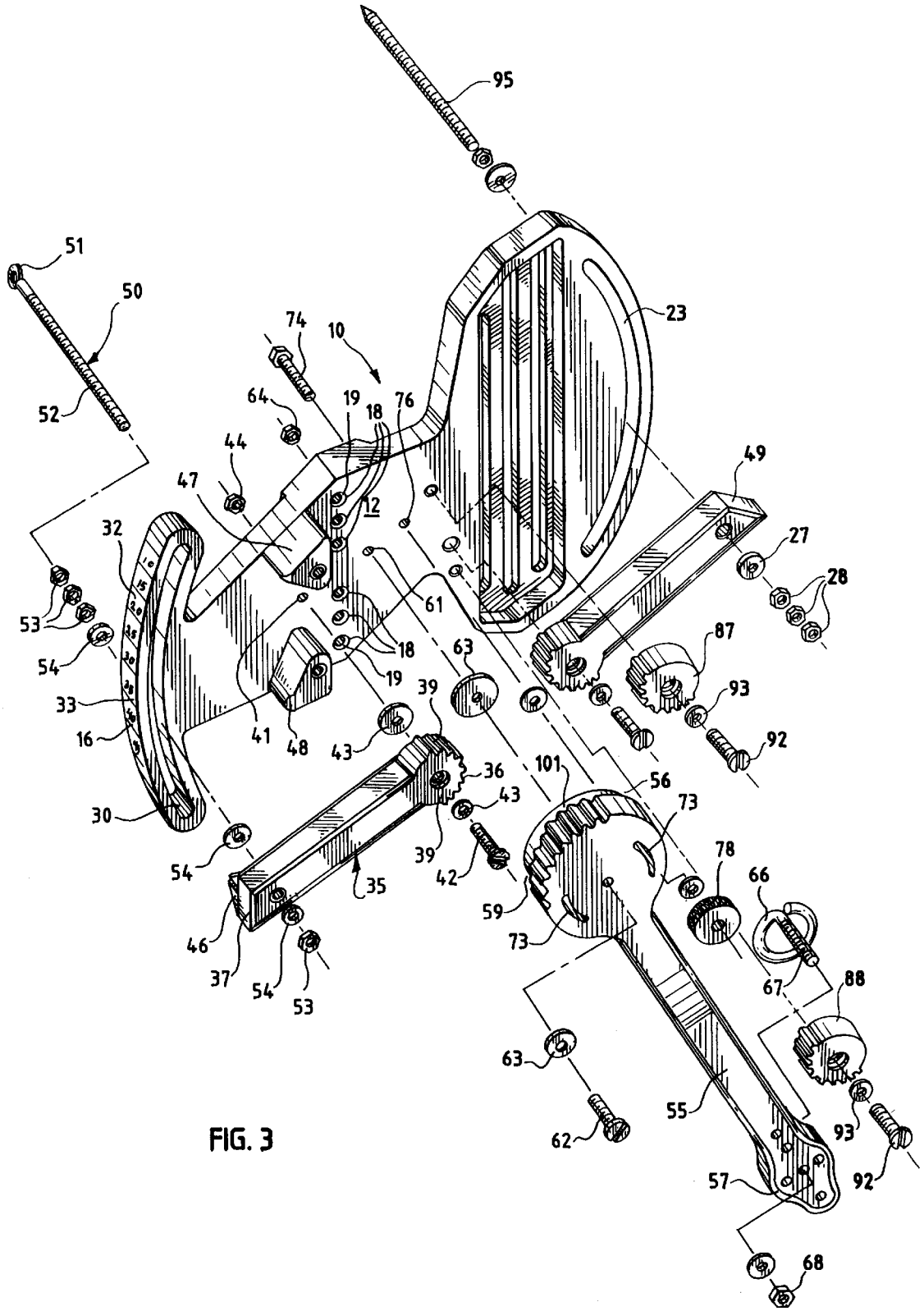
FIG. 3 is an exploded perspective view showing the manner in which the elements of the improved sight assembly of the present invention are in connected cooperative engagement.

Since all of the elements and parts forming sight assembly 10 of the present invention are bolted into position, and given the configuration and construction of main sight body 12, sight assembly 10 of the present invention may be used on either left handed or right handed bow, depending on the dexterity of the user. Only sight adjustment lever 55 need be rebolted to sight body 12 when sight body 12 is mounted on the reverse side of the bow (as shown in FIG. 3) such that a left handed user may similarly employ the same sight assembly 10. This feature is a significant advancement over sight assemblies which include complicated mechanical levers and movements which are not readily reversible.

In operation, sight assembly 10 is mounted to bow B in a manner suitable for either a right handed or left handed user as described above. Manipulation of sight adjustment lever 55 via finger ring 66 causes simultaneous unidirectional movement of rear sight arm 35 and front sight arm 49. This is accomplished through the direct meshing engagement of gear teeth 59 of sight adjustment lever 55 and gear teeth 39 of rear sight arm 35 and direct meshing engagement with gear teeth 59 of sight adjustment arm 55 and gear teeth 89 of first idler gear 87 and gear teeth of second idler gear 88, gear teeth of first and second idler gears then being in meshing engagement with the gear teeth 91 of front sight arm 49. This configuration results in both sight arms moving in the same direction. For example, when sight adjustment lever 55 is moved toward the archer, rear sight arm 35 being in direct meshing engagement with sight adjustment lever 55 will move in a downward direction. At the same time, the gear teeth 89,90 of first idler gear 87 and second idler gear 88 are directly meshingly engaged with gear teeth 59 of sight adjustment lever 55 on its opposite side, causing first and second idler gears to move in an opposite direction as gear teeth 39 of rear sight arm 35. Front sight arm 49 is in direct meshing engagement with first 87 and second idler gears 88, and, therefore, moves in the opposite direction as the gears, causing downward movement of front sight arm 49. Thus, in this fashion, both rear sight arm 35 and front sight arm 49 move in the same direction, namely, downward in this example.

In use, an archer, after sighting a target, brings the bow to full draw. The archer then views the target through peep ring 51 while maintaining an intersection of peep ring 51 with sight pin 95. At the proper position, the target will be viewed through peep ring 51 while peep ring 51 is intersected with sight pin 95. At this point, a distance can be ascertained by reading the indicia 16 by distance pointer 46 from distance indicator 33.

Alternatively, an archer may view a target through peep ring 51 and, while maintaining a view of the target through peep ring 51 by manipulation of sight adjustment lever 55, can move the bow up and down until sight pin 95 intersects peep ring 51. Again, once peep ring 51, sight pin 95 and target are all in alignment, a distance may be read from the distance indicator 33.

Figure 4:
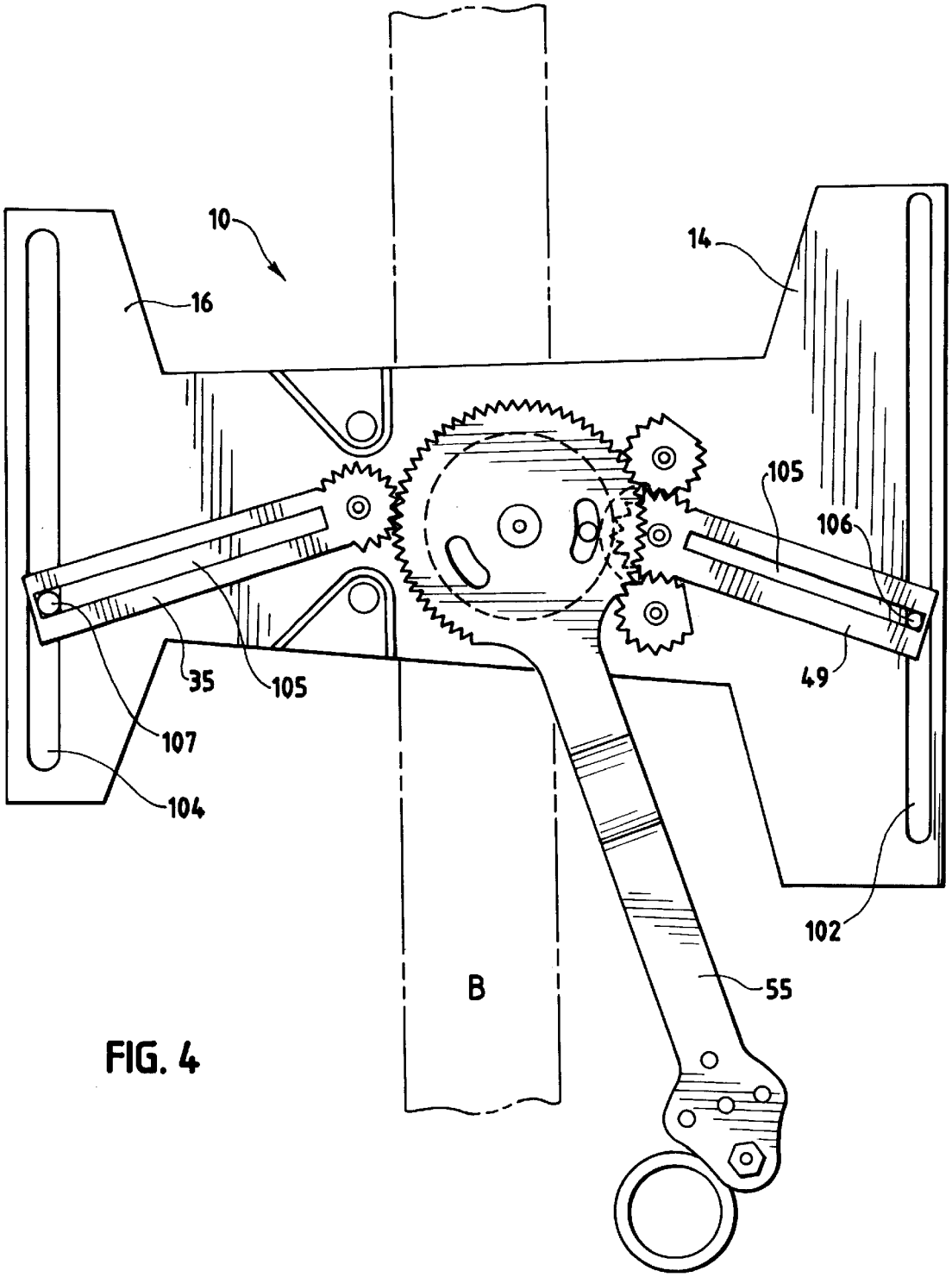
FIG. 4 is a side elevational view illustrating the inventive device in an alternative embodiment having vertical guide slots.

In an alternative embodiment, front body portion 14 and rear body portion 16 have vertical guide slots 102, 103 (FIG. 4) as opposed to curvilinear slots. In this embodiment, front sight arm 49 and rear sight arm 35 are channeled 104, 105 throughout their thickness. Front sight arm 49 carries a floating sight pin 106 in its channel 105. Rear sight arm 35 carries a floating peep sight 107 in its channel 104. The remainder of sight assembly 10 is constructed in the same fashion as when curvilinear slots are employed. In an operation of this embodiment, as sight adjustment lever 55 is manipulated, front sight arm 49 and rear sight arm 35 continue to move unidirectionally. As rear sight arm 35 and front sight arm 49 move in a generally up and down direction, sight pin 95 slides along front sight arm channel 105 while simultaneously moving along vertical slotted sight pin guide 102, and peep sight 50 slides along rear sight arm channel 104 while simultaneously moving along vertical slotted peep sight guide 103.

The inventors have found that the vertical slotted embodiment enlarges sight assembly 10 somewhat, but is more accurate for long distance shooting such as seen in target shooting competitions where distances may range to 70 yards or more. The curvilinear slotted guide embodiment results in a smaller sight assembly 10 and is better suited for hunting environments where close range shots, to approximately 40 yards maximum, are normally encountered.

The present invention further permits a variety of different size peep rings 51 since the peep ring is threaded to the threaded body 52 of the rear peep sight 50. Hence, a plurality of different sized peep rings 51 may be provided depending upon the particular comfort and desire of the user. This feature in conjunction with the fact that rear peep sight 50 is moveable and located adjacent to the user's eye, permits a more accurate sighting of the target while giving the archer some degree of flexibility in terms of constructing sight assembly 10 in the manner deemed comfortable.

The inventors have found that a gear ratio of between 2.5:1 and 3:1 between the gear teeth 59 of sight adjustment lever 55 and gear teeth 39 of rear sight arm 35, and the gear teeth 89, 90 of first 87 and second idler 88 gears and gear teeth 91 of front sight arm 49, decreases the user's finger travel while adjusting the sight. Hence, using these gear ratio ranges keeps manipulation of sight adjustment lever 55 to a minimum while still permitting an accurate sighting of a target via a two-point sighting system.

It will be appreciated from the above description that the present invention provides an improved bow sight assembly which permits a user to utilize a two-point sighting system consisting of a moveable rear peep sight which operates in conjunction with a moveable forward sight pin, thereby permitting the user to sight a target through the peep ring via a floating sight pin. While the above specification describes the preferred embodiment of the present invention, those skilled in the arts will quickly understand there are alternate embodiments which fall within the spirit of the invention, the scope of which is to be measured only by the appended claims.

We claim:

1. An archery bow sight comprising:

a main sight body having a forward body portion and a rear body portion, the main sight body having attachment means interposed between the forward body portion and the rear body portion for attaching the sight to an archery bow, the forward body portion having a forward slotted sight guide, the rear body portion having a rear slotted sight guide, a rear sight arm pivotally carried on the main sight body having a forward end and a back end, the forward end of the rear sight arm provided with gear teeth for affecting movement of the rear sight arm, and provided with a peep sight mounted thereon adjacent the back end thereof, the peep sight adapted to travel within the confines of the rear slotted rear guide, a forward sight arm pivotally carried on the main sight body having a front end and a rear end, the rear end of the forward sight arm provided with gear teeth for affecting movement of the forward sight arm, and provided with a sight pin mounted thereon adjacent to the front end thereof, the sight pin adapted to travel within the confines of the front slotted sight guide, a sight adjustment lever pivotally secured to the main sight body having a top end and a bottom end, the top end provided with gear teeth and the bottom end provided with finger control means, an idler gear having gear teeth pivotally secured to the main sight body adjacent to the gear teeth of the sight adjustment lever and above the gear teeth of the forward sight arm, the gear teeth of the sight adjustment lever being positioned to be in meshing engagement of the gear teeth of the rear sight arm and with the gear teeth of the idler gear, the gear teeth of the idler gear being in simultaneous meshing engagement with the gear teeth of the forward sight arm, such that movement of the sight adjustment lever via the finger control means results in a concomitant movement of the rear sight arm and peep sight and the idler gear, the concomitant movement of the idler gear causing movement of the front sight arm and sight pin in the same direction as the rear sight arm and peep sight, and the rear body portion of the main sight body provided with a distance scale and the rear sight arm provided with a distance reader which operates in conjunction with the distance scale, whereby movement of the sight adjustment lever causes unidirectional movement of the rear sight arm and peep sight and front sight arm and sight pin, thereby allowing a readout of a target distance via the distance scale and distance reader when the sight pin is maintained in alignment through the peep sight, whereby a two-point sight assembly is provided which measures the distance to a target formed by a moveable rear peep sight and a moveable forward sight pin.

2. The archery bow sight of claim 1 wherein the forward slotted sight guide is curvilinear and forming a path of travel for the sight pin, moveable along the length thereof in response to movement of the forward sight arm.

3. The archery bow sight of claim 1 wherein the rear body portion is curvilinear and further having an outer rear surface, forming a path of travel for the peep sight moveable along the length thereof in response to movement of the rear sight arm.

4. The archery bow sight of claim 1 wherein the forward slotted sight guide is vertical and forming a path of travel for the sight pin, moveable along the length thereof in response to movement of the forward sight arm.

5. The archery bow sight of claim 1 wherein the rear body portion is vertical and further having an outer rear surface, forming a path of travel for the peep sight moveable along the length thereof in response to movement of the rear sight arm.

6. The archery bow sight of claim 3, wherein the outer rear surface of the curvilinear slotted sight guide of the rear body portion is provided with a series of distance indicia imprinted thereon and the rear sight arm is provided with a distance reader which operates in conjunction with the distance indicia to permit the reading of distance to target in response to movement of the rear sight arm and peep sight when visual alignment of the sight pin is maintained through the peep sight.

7. The archery bow sight of claim 5, wherein the outer rear surface of the vertical slotted sight guide of the rear body portion is provided with a series of distance indicia imprinted thereon and the rear sight arm is provided with a distance reader which operates in conjunction with the distance indicia to permit the reading of distance to target in response to movement of the rear sight arm and peep sight when alignment of the sight pin is maintained through the peep sight.

8. The archery bow sight of claim 1 wherein the forward sight arm has a channel, the channel enabling insertion of a floating sight pin, the sight pin being moveable along the channel.

9. The archery bow sight of claim 1 wherein the rear sight arm has a channel, the channel enabling insertion of a floating peep sight, the peep sight being moveable along the channel.

10. The archery bow sight of claim 1 wherein the attachment means comprises a plurality of attachment apertures for accommodating attachment bolts there through to secure attach the main sight body to an archery bow.

11. The archery bow sight of claim 1 wherein the finger control means comprises a finger ring mounted at the bottom end of the sight attachment lever to accommodate the user's finger therein, and permit controlling movement of the sight adjustment lever with a single lever.

12. An archery bow sight comprising:

a main sight body having a forward body portion and a rear body portion, the main sight body having attachment means interposed between the forward body portion and the rear body portion for attaching the sight to an archery bow, the forward body portion having a forward slotted sight guide, the rear body portion having a rear slotted sight guide, a rear sight arm pivotally carried on the main sight body having a forward end and a back end, the forward end of the rear sight arm provided with gear teeth for affecting movement of the rear sight arm, and provided with a peep sight mounted thereon adjacent the back end thereof, the peep sight adapted to travel within the confines of the rear slotted rear guide, a forward sight arm pivotally carried on the main sight body having a front end and a rear end, the rear end of the forward sight arm provided with gear teeth for affecting movement of the front side arm, and provided with a sight pin mounted thereon adjacent to the front thereof, the sight pin adapted to travel within the confines of the front slotted sight guide, a sight adjustment lever pivotally secured to the main sight body having a top end and a bottom end, the top end provided with gear teeth and the bottom end provided with finger control means, a first idler gear having gear teeth and a second idler gear having gear teeth, the first idler gear pivotally secured to the main sight body adjacent to the gear teeth of the sight adjustment lever and above the gear teeth of the forward sight arm, and the second idler gear pivotally secured adjacent to the gear teeth of the sight adjustment lever and below the gear teeth of the forward sight arm, the gear teeth of the sight adjustment lever being positioned to be in meshing engagement of the gear teeth of the rear sight arm and with the gear teeth of the idler gears, the gear teeth of the idlers being in simultaneous meshing engagement with the gear teeth of the forward sight arm, such that movement of the sight adjustment lever via the finger control means results in a concomitant movement of the rear sight arm and peep sight and the idler gears, the concomitant movement of the idler gears causing movement of the front sight arm and sight pin in the same direction as the rear sight arm and peep sight, and the rear body portion of the main sight body provided with a distance scale and the rear sight arm provided with a distance reader which operates in conjunction with the distance scale, whereby movement of the sight adjustment lever causes unidirectional movement of the rear sight arm and peep sight and front sight arm and sight pin, thereby allowing a readout of the target distance via the distance scale and distance reader when the sight pin is maintained in alignment with the peep sight, whereby a two-point sight assembly is provided which measures distance to target formed by a moveable rear peep sight and a moveable forward sight pin.

13. The archery bow sight of claim 12 wherein the forward slotted sight guide is curvilinear and forming a path of travel for the sight pin, moveable along the length thereof in response to movement of the forward sight arm.

14. The archery bow sight of claim 12 wherein the rear body portion is curvilinear and further having an outer rear surface, forming a path of travel for the peep sight moveable along the length thereof in response to movement of the rear sight arm.

15. The archery bow sight of claim 12 wherein the forward slotted sight guide is vertical and forming a path of travel for the sight pin, moveable along the length thereof in response to movement of the forward sight arm.

16. The archery bow sight of claim 12 wherein the rear body portion is vertical and further having an outer rear surface, forming a path of travel for the peep sight moveable along the length thereof in response to movement of the rear sight arm.

17. The archery bow sight of claim 14, wherein the outer rear surface of the curvilinear slotted sight guide of the rear body portion is provided with a series of distance indicia imprinted thereon and the rear sight arm is provided with a distance reader which operates in conjunction with the distance indicia to permit the reading of distance to target in response to movement of the rear sight arm and peep sight when alignment of the sight pin is maintained through the peep sight.

18. The archery bow sight of claim 16, wherein the outer rear surface of the vertical slotted sight guide of the rear body portion is provided with a series of distance indicia imprinted thereon and the rear sight arm is provided with a distance reader which operates in conjunction with the distance indicia to permit the reading of distance to target in response to movement of the rear sight arm and peep sight when alignment of the sight pin is maintained through the peep sight.

19. The archery bow sight of claim 12 wherein the forward sight arm has a channel, the channel enabling insertion of a floating sight pin, the sight pin being moveable along the channel.

20. The archery bow sight of claim 12 wherein the rear sight arm has a channel, the channel enabling insertion of a floating peep sight, the peep sight being moveable along the channel.

21. The archery bow sight of claim 12 wherein the attachment means comprises a plurality of attachment apertures for accommodating attachment bolts there through to secure attach the main sight body to an archery bow.

22. The archery bow sight of claim 12 wherein the finger control means comprises a finger ring mounted at the bottom end of the sight attachment lever to accommodate the user's finger therein, and permit controlling movement of the sight adjustment lever with a single lever.

23. An archery bow sight comprising:

a main sight body having a forward body portion and a rear body portion, the main sight body having attachment means interposed between the forward body portion and the rear body portion for attaching the sight to an archery bow, the forward body portion having a forward vertical slotted sight guide, the rear body portion having a rear vertical slotted sight guide, a rear channeled sight arm pivotally carried on the main sight body having a forward end and a back end, the forward end of the rear channeled sight arm provided with gear teeth for affecting movement of the rear channeled sight arm, and provided with a floating peep sight mounted thereon adjacent the back end thereof, the floating peep sight adapted to travel within the confines of the rear vertical slotted rear guide, a forward channeled sight arm pivotally carried on the main sight body having a front end and a rear end, the rear end of the forward channeled sight arm provided with gear teeth for affecting movement of the front channeled sight arm, and provided with a floating sight pin mounted thereon adjacent to the front thereof, the floating sight pin adapted to travel within the confines of the front vertical slotted sight guide, a sight adjustment lever pivotally secured to the main sight body having a top end and a bottom end, the top end provided with gear teeth and the bottom end provided with finger control means, an idler gear having gear teeth pivotally secured to the main sight body adjacent to the gear teeth of the sight adjustment lever and above the gear teeth of the forward channeled sight arm, the gear teeth of the sight adjustment lever being positioned to be in meshing engagement of the gear teeth of the rear channeled sight arm and with the gear teeth of the idler gear, the gear teeth of the idler being in simultaneous meshing engagement with the gear teeth of the forward channeled sight arm, such that movement of the sight adjustment lever via the finger control means results in a concomitant movement of the rear channeled sight arm and floating peep sight and the idler gear, the concomitant movement of the idler gear causing movement of the front channeled sight arm and floating sight pin in the same direction as the rear channeled sight arm and floating peep sight, and the rear body portion of the main sight body provided with a distance scale and the rear channeled sight arm provided with a distance reader which operates in conjunction with the distance scale, whereby movement of the sight adjustment lever causes unidirectional movement of the rear channeled sight arm and floating peep sight and front sight arm and floating sight pin, thereby allowing a readout of the distance target via the distance scale and distance reader when the floating sight pin is maintained in alignment vision through the floating peep sight, whereby the front vertical slotted sight guide enables vertical movement of the floating sight pin and the forward channeled sight arm enables simultaneous horizontal movement of the floating sight pin, and the rear vertical slotted sight guide enables vertical movement of the floating peep sight and the rear channeled sight arm enables simultaneous horizontal movement of the floating peep sight.

24. The archery bow sight of claim 1 having a second idler gear having gear teeth pivotally attached adjacent to the gear teeth of the sight adjustment arm and below the gear teeth of the front channeled sight arm.

25. The archery bow sight of claim 23, wherein the vertical slotted sight guide of the rear body portion has an outer rear surface having a series of distance indicia imprinted thereon and the rear sight arm is provided with a distance reader which operates in conjunction with the distance indicia to permit the reading of distance to target in response to movement of the rear sight arm and peep sight when visual alignment of the sight pin is maintained through the peep sight.

26. The archery bow sight of claim 23 wherein the attachment means comprises a plurality of attachment apertures for accommodating attachment bolts there through to secure attach the main sight body to an archery bow.

27. The archery bow sight of claim 23 wherein the finger control means comprises a finger ring mounted at the bottom end of the sight attachment lever to accommodate the user's finger therein, and permit controlling movement of the sight adjustment lever with a single lever.

28. A method for using a bow mounted two-point sight for archery bows to sight-in a target comprising the steps of:

locating a target, viewing the target through a bow mounted peep sight, aligning the bow mounted peep sight with a bow mounted sight pin such that the bow mounted sight pin intersects the bow mounted peep sight.

* * * * *